US006581913B1

(12) United States Patent
Conomos et al.

(10) Patent No.: US 6,581,913 B1
(45) Date of Patent: Jun. 24, 2003

(54) TRANSMISSION LIFT DEVICE

(76) Inventors: Gregory J. Conomos, 3905 Sequoia Tr. W., Georgetown, TX (US) 78628; Dale L. Conway, Rte. 1, Box 19D, Georgetown, TX (US) 78626

( * ) Notice: Subject to any disclaimer, the term of this patent is extended or adjusted under 35 U.S.C. 154(b) by 0 days.

(21) Appl. No.: 10/081,631

(22) Filed: Feb. 22, 2002

(51) Int. Cl.[7] ..... B66F 3/00

(52) U.S. Cl. ..... 254/133 R; 254/93 R; 254/134

(58) Field of Search ..... 254/133 R, 134, 254/2 R, 2 B, 2 C, 93 H, 93 R, DIG. 4, DIG. 16

(56) References Cited

U.S. PATENT DOCUMENTS

| | | | | |
|---|---|---|---|---|
| 4,166,608 A | | 9/1979 | Schelle | |
| 4,202,539 A | | 5/1980 | Polastri | |
| 4,500,071 A | | 2/1985 | Bagwell | |
| 4,770,304 A | | 9/1988 | Woods | |
| 4,787,600 A | | 11/1988 | Bode | |
| 4,923,174 A | * | 5/1990 | Loechner | 254/105 |
| 4,949,540 A | | 8/1990 | Wich | |
| 5,127,638 A | | 7/1992 | Kent | |
| 5,156,375 A | * | 10/1992 | Liegel et al. | 254/134 |
| 5,160,125 A | | 11/1992 | Jenkins | |
| 5,259,602 A | | 11/1993 | Rogos | |
| 5,273,332 A | | 12/1993 | Currie | |
| 5,560,084 A | | 10/1996 | Baker | |
| 5,562,271 A | | 10/1996 | Davis, Jr. | |
| 5,895,030 A | | 4/1999 | Mohun | |
| 5,931,500 A | | 8/1999 | Dagnese | |
| 5,975,496 A | * | 11/1999 | Hong et al. | 254/2 R |
| 6,189,853 B1 | | 2/2001 | Kuhn | |
| 6,450,481 B1 | * | 9/2002 | Oxtoby | 254/93 H |
| 6,505,815 B1 | * | 1/2003 | Dellamore | 254/2 B |

OTHER PUBLICATIONS http://www.superlifts.com/html/accessories.htm.
http://www.mytoolstore.com/astro/asthyd06.html.
http://www.bonksauto.com/standit.htm.
http://www.bonksauto.com/ba2000a.htm.
http://www.bonksauto.com/ba3000.htm.
http://www.bonksauto.com/ba4000.htm.

* cited by examiner

*Primary Examiner*—Robert C. Watson
(74) *Attorney, Agent, or Firm*—Randal D. Hamburg

(57) ABSTRACT

The invention is a transmission lift and stand to elevate and support one or more transmissions or other heavy vehicular parts for stationary work and repair at a height of optimal comfort and access by a mechanic, the device receiving transmission clamps and adapters attached to the transmission of vehicle. The transmission lift utilizes a piston ram to force a crossbar attached to a slider member up and down a main support post, with a locking mechanism to lock the slider assembly at a desired location on the main support post, elevating and maintaining up to four transmissions or other vehicle parts, and allowing for the raising a lowering the attached parts as needed during repair.

10 Claims, 11 Drawing Sheets

TRANSMISSION LIFT DEVICE

I. BACKGROUND OF THE INVENTION

1. Field of Invention

The invention is a transmission lift and stand to elevate and support one or more transmissions or other heavy vehicular parts for stationary work and repair at a height of optimal comfort and access by a mechanic, the device receiving transmission clamps and adapters attached to the transmission of vehicle. The transmission lift utilizes a piston ram to force a crossbar attached to a slider member up and down a main support post, with a locking mechanism to lock the slider assembly at a desired location on the main support post, elevating and maintaining up to four transmissions or other vehicle parts, and allowing for the raising a lowering the attached parts as needed during repair.

2. Description of Prior Art

The following United States patents were discovered and are disclosed within this application for utility patent. All relate to transmission stands or lift devices. In addition, several other transmission lift devices were located on the Internet and they are also disclosed.

The first series of patents relates to stands which disclose some type of lift mechanism. U.S. Pat. No. 5,895,030 to Mohun, discloses a wheel drum and hub stand wherein a wheel or hub is attached to a vehicle hub or wheel, rolled back and then raised or lowered to perform repair or maintenance, after which the still attached wheel or hub is replaced on the vehicle. A "cherry picker" hoist is disclosed in U.S. Pat. No. 4,770,304 to Woods, having a retractable arm for lifting and lowering a vehicle engine from within the hood of a vehicle. Dual hydraulic lifts which are used to lift entire vehicles are disclosed in U.S. Pat. No. 4,500,071 to Bagwell and U.S. Pat. No. 4,949,540 to Wich, these devices grasping from the sides of the vehicles and lifting the vehicle in a vertical direction, maintaining a synchronism between the two sides to promote level lifting.

Another series of lift related device deal with static or non-moving lift devices, specifically stands for holding items in place or attaching to other items that move. A portable wheel hub remover mounted to a dolly or fork lift has a support plate bolted to the stud of a wheel on a vehicle is disclosed in U.S. Pat. No. 5,127,638 to Kent. In U.S. Pat. No. 5,273,332 to Currie, a top side transmission lift attaching to a non-specific lifting device includes a chain pulley system and a sliding crank hoist to lift a transmission from above. Three stationary transmission stands or jacks are disclosed in U.S. Pat. No. 6,189,853 to Kuhn, U.S. Pat. No. 5,160,125 to Jenkins and U.S. Pat. No. 4,202,539 to Polastri, et al. A pivoting stand for front wheel drive transmission removal and support is disclosed in U.S. Pat. No. 5,259,602 to Rogos, which attaches to a transmission, rolls back from under the vehicle with the transmission attached, then pivots ninety degrees to lift and support the transmission for work or repair.

Two patents, U.S. Pat. No. 4,787,600 to Bode and U.S. Pat. No. 4,166,608 to Schelle, utilize a floor jack to provide the mounted device with a lift a lowering means, attaching the devices to the floor jack, rolling the attached device under a vehicle, attaching the device to a transmission, lowering the jack, removing the transmission from under the car, repairing the transmission and then reattaching the transmission, and lifting it in place using the device and the floor jack to reattach the transmission to the vehicle. An adapter to mount a transmission on an engine stand is disclosed in U.S. Pat. No. 5,562,271 to Davis, Jr.

A friction slide mechanism is disclosed in U.S. Pat. No. 5,560,084 to Baker, which comprises a body which is shaped to fit within a channel of a stay with a plastic skin overlying the body to separate the body from the channel of the stay with an adjustable means cooperating with the body for driving the plastic away from the body to regulate the friction between the slider and the stay.

In a search of other items which are currently on the market, a series of transmission jacks, manufactured by SUPERLIFTS.COM is found at www.superlifts.com.html/accessories.htm. These jacks include either air or hydraulic power, four adjustable load support arms, a foot operated pump, and a wide wheeled base. A similar telescoping transmission jack, made by Astro is found at www.mytoolstore.com/astro/asthyd06.html. These two devices are generic transmission jacks and are designed to roll under the vehicle to remove the transmission from the vehicle and transfer to a work area to perform the repair work. They also lift the transmission back under the vehicle to attach the repaired transmission. These devices, and several similar products on the market, are used in conjunction with the transmission lift of the present invention, bearing no functional or structural similarity.

Bonks Automotive makes several different models of transmission jacks, which are varied by weight capacity, these stands operating by means of a 12 volt electrical winch, much like those used on the front bumper of a pickup, usually powered by a 12 volt battery strapped to its stand. See, www.bonksauto.com. The Bonk design slides metal on metal and does not include any wear pads, nor does the slider mechanism include the same elements and attachment or relation to the other material components as the present invention. They also generally relate to a single transmission, as opposed to the present invention, holding as many as four transmissions. See also, www.RNBuilder.com.

None of the above noted patents or products, individually or in combination, include the same features or elements as the transmission lift device disclosed in this patent.

II. SUMMARY OF THE INVENTION

The primary objective of the subject transmission lift is to provide a transmission lift to facilitate the handling and movement of a transmission during the dismantling and rebuilding process to prevent damage to parts and personnel during this several step processes, eliminating the need for shop personnel to ever lift the transmission, providing a secure and stable means of access to all parts of the transmission during the entire repair procedure. The device has a maximum height that places the transmission at a suitable working height and a minimum height that allows the transmission to be transferred from the transmission jack after removal and prior to replacement. This replaces the presently available procedure of manually lifting the transmission by one or more personnel onto a flat immobile work surface, repairing the transmission in an unsupported manner, and manually lifting the repaired transmission back onto the transmission jack.

A second objective of the subject transmission lift is to provide the lift in a floor mounted embodiment, where the transmission work area is set aside, with the transmission lift accommodating up to four transmissions at one time for repair or rebuild.

A third objective is to provide the transmission lift with a pneumatic lift mechanism, connecting to a supplied shop compressed air line, the pneumatic lift mechanism having a simple air cylinder having a rubber cup seal, a replaceable wear band, a ram and a crossbar assembly within a square tubing support post, the crossbar assembly connecting to a slider assembly having internal wear pads between the support post and the slider assembly, the slider assembly also having a locking pawl mechanism interacting with a plurality of vertically oriented lock lugs on the support post, to securely lock the slider assembly in a fixed position on the support post during work on an attached transmission. The slide assembly is provided with numerous transmission adapter clamps which are bolted to the slider assembly, for grasping and holding the various transmissions of different makes and models of automobiles and trucks.

A fourth objective of the invention is to provide a transmission lift having multiple surfaces for the attachment of a variety of transmission clamp accommodating a variety of transmissions, the multiple surfaces having several threaded holes in different configurations, corresponding to the bolt attachments for the various transmission clamps and adapters.

III. DESCRIPTION OF THE DRAWINGS

The following drawings are submitted with this utility patent application.

FIG. 1 is a view of the transmission lift device.

FIG. 2*a* is a top view of the slider assembly.

FIG. 2*b* is a side view of the slider assembly.

FIG. 2*c* is a perspective view of the slider assembly.

FIG. 3*a* is a top view of the crossbar.

FIG. 3*b* is an end view of the crossbar.

FIG. 3*c* is a side view of the crossbar.

FIG. 3*d* is a perspective view of the crossbar.

FIG. 3*e* is a perspective view of a second embodiment of the crossbar.

FIG. 4*a* is a side view of the ram assembly and piston assembly.

FIG. 4*b* is a top view of the ram assembly and piston assembly.

FIG. 5*a* is a top view of the components of piston assembly.

FIG. 5*b* is a side view of the components of the piston assembly.

Figure 12A:
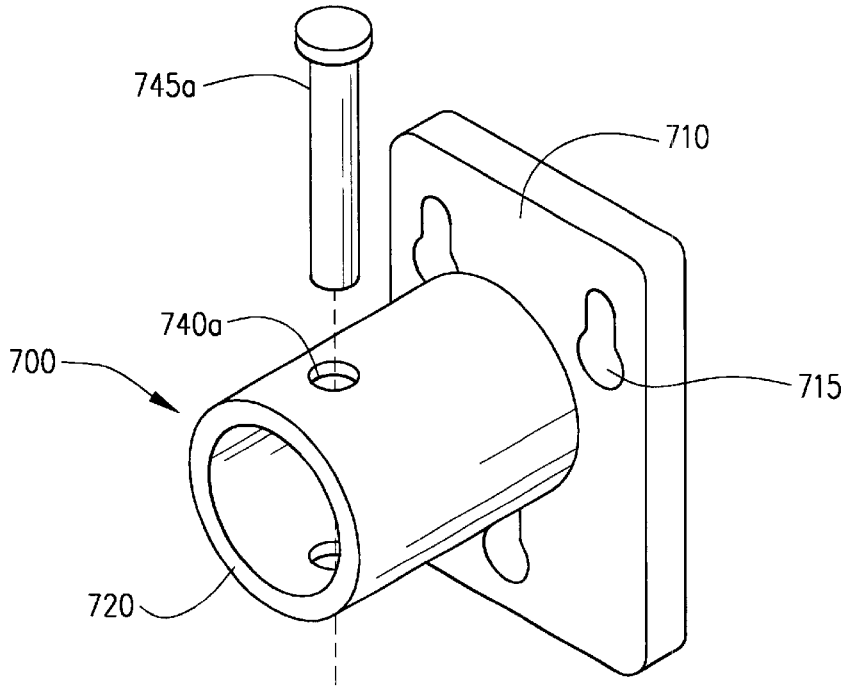

FIG. 12*a* is a view of the adapter clamp.

Figure 12B:
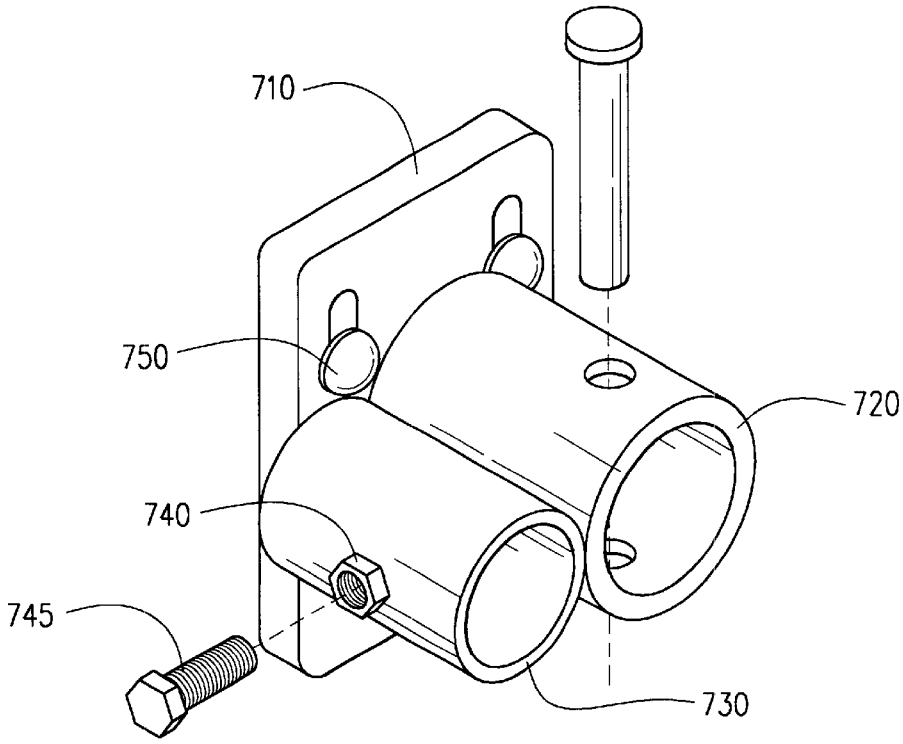

FIG. 12*b* is a second view of the adapter clamp.

IV. DESCRIPTION OF THE PREFERRED EMBODIMENT

The invention, as shown in FIGS. 1–11 of the drawings, is a pneumatic transmission lift 10 upon which a plurality of automobile transmissions of various size, make and model may be attached and raised to a level to accommodate the repair, maintenance and rebuilding of the automobile transmissions, the device comprising essentially a vertical hollow main post 100 within which is attached a piston air ram 200, having an air cylinder assembly 210, a ram assembly 230 and a piston assembly 250, attaching to a crossbar 300, the crossbar 300 further attached to a slider assembly 400 having a plurality of flat outer surfaces 452 upon which is bolted a clamp adapter 700 to which may be attached a multiplicity of transmission clamps fastened to the plurality of automobile transmissions, the slider assembly 400 vertically sliding upon an outer surface 160 of the main post 100. The slider assembly 400 also has a slider locking mechanism 500 which provides a safety attachment to prevent the slider assembly 400 from being lowered without intent. The piston air ram 200 receives compressed air through an air supply assembly 600 placed upon and within the main post 100, the air supply assembly attaching to an standard compressed air line from a shop or garage.

The transmission lift 10 further defines the main post 100 having an upper end 110, a plurality of sides 120, including at least two opposing sides 120, a lower end 130, a length, an interior longitudinal cavity 140, an interior surface 150, the outer surface 160, an outer diameter, two longitudinal crossbar channels 170 placed within two opposing sides 120 from the interior surface 150 to the outer surface 160, longitudinally spaced locking lugs 170, outwardly protruding from at least one side 120 on the outer surface 160 of the main post 100, other than the two sides 120 containing the longitudinal crossbar channels 170, and a base plate 190 attached to the lower end 130. In a preferred embodiment, the main post 100 is square, as shown in FIGS. 1 and 8–10 of the drawings, and the base plate 190 is anchored to the floor.

The air cylinder assembly 210, as shown in FIGS. 4*a*–7, has an upper portion 212, an inner cavity 216 having an inner diameter, and a lower portion 218 which is attached to an air cylinder base 220 having an air input receiver 222 and an air access channel 224, the air access channel 224 providing passage to introduce air from the air input receiver 222 to the inner cavity 216. The ram assembly 230 includes an end cap 232 having an upper surface 234 within which is places a plurality of threaded crossbar anchor holes 236. This end cap 232 is attached to an upper end 242 of a ram arm 240, the ram arm 240 also having a lower end 246 from which depends a threaded piston mounting stud 248. The piston assembly 250, more specifically shown in FIGS. 4*a*–5*b*, is placed upon the threaded piston mounting stud 248 and attached by an internally threaded mounting nut 290. The piston assembly 250 comprises a piston 260, having an upper surface 262, a lower surface 268, a recessed ram receiver area 264, a central mounting hole 265 and an outer edge 266, a wear band 270 having an inner surface 272, an outer diameter and an outer surface 274, the inner surface 272 tightly engaging the outer edge 266 of the piston 260, and a rubber seal cup 280, provided with an upper surface 282, a diameter and a central mounting hole 286.

The piston assembly 250 is assembled by forcing the wear band 270 upon the piston 250, inserting the threaded piston mounting stud 248 through the central mounting hole 265 of the piston 260 with the upper surface 262 of the piston 260 towards the ram arm 240 wherein the lower end 246 of the ram arm 240 rests within the recessed ram receiver area 264, then inserting the central mounting hole 286 of the rubber seal cup 280 onto the threaded piston mounting stud 248 with the upper surface 282 of the rubber seal cup 280 in contact with the lower surface 268 of the piston 260 and tightening the internally threaded mounting nut 290 on the threaded piston mounting stud 248, firmly attaching the piston assembly 250 to the ram assembly 230. The diameter of the rubber seal cup 280 is slightly greater than the inner diameter of the air cylinder assembly 210, while the outer diameter of the wear band 270 is slightly less than the inner diameter of the air cylinder assembly 210.

The piston assembly 250 attached to the ram assembly 230 is then placed within the air cylinder assembly 210 with the piston assembly 250 being inserted first, forming the piston air ram 200. Pneumatic resistance must be present when the ram assembly 230 is raised and lowered within the air cylinder assembly 210. After insertion, the plurality of threaded crossbar anchor holes 236 should protrude above the upper portion 212 of the air cylinder assembly 210. Air introduced through the air input receiver 222 should provide lift to the ram assembly 230 within the air cylinder assembly 210, and any air contained within the inner cavity 216 of the air cylinder assembly 210 below the piston assembly 250 should be released through the air access channel 224 to the air input receiver 222. Air must not be allowed to escape between the rubber seal cup 280 and the inner cavity 216 of the air cylinder assembly 210. After assembly, the assembled piston air ram 200 is placed within the interior longitudinal cavity 140 of the main post 100 with the air cylinder base 220 attached to the base plate 190.

The crossbar 300, as shown in FIGS. 3*a*–3*d*, preferably a singular solid metal bar, has an upper surface 310, two ends 320, each end 320 having at least two internally threaded slider bolt holes 325, a lower surface 330, and a plurality of smooth bore machine bolt holes 335 through the crossbar 300 from the upper surface 310 to the lower surface 330. The crossbar 300 is attached to the end cap 232 of the ram assembly 230 already within the interior longitudinal cavity 140 of the main post 100 by the insertion of at least two machine bolts 350 through the smooth bore machine bolt holes 335 of the crossbar 300 into the threaded crossbar anchor holes 236 of the end cap 232, tightening the crossbar 300 onto the end cap 232. The two ends 320 of the crossbar 300 extend through the longitudinal crossbar channel 170, slightly beyond the outer surface 160 of the main post 100.

Figure 2A:
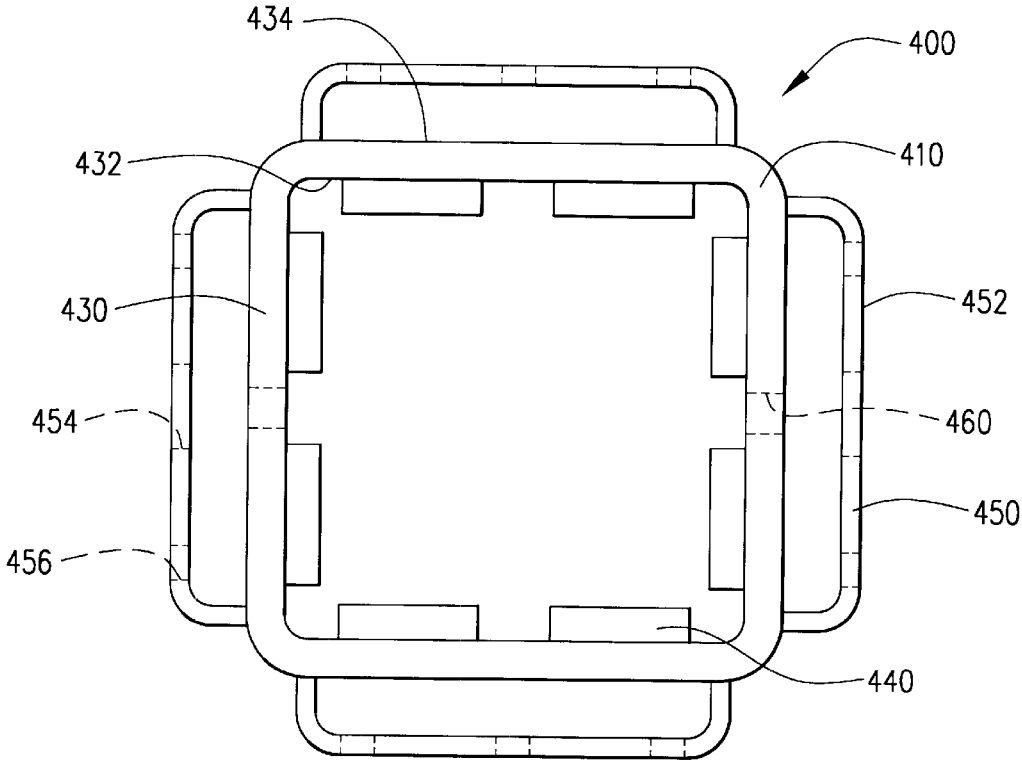
Figure 2B:
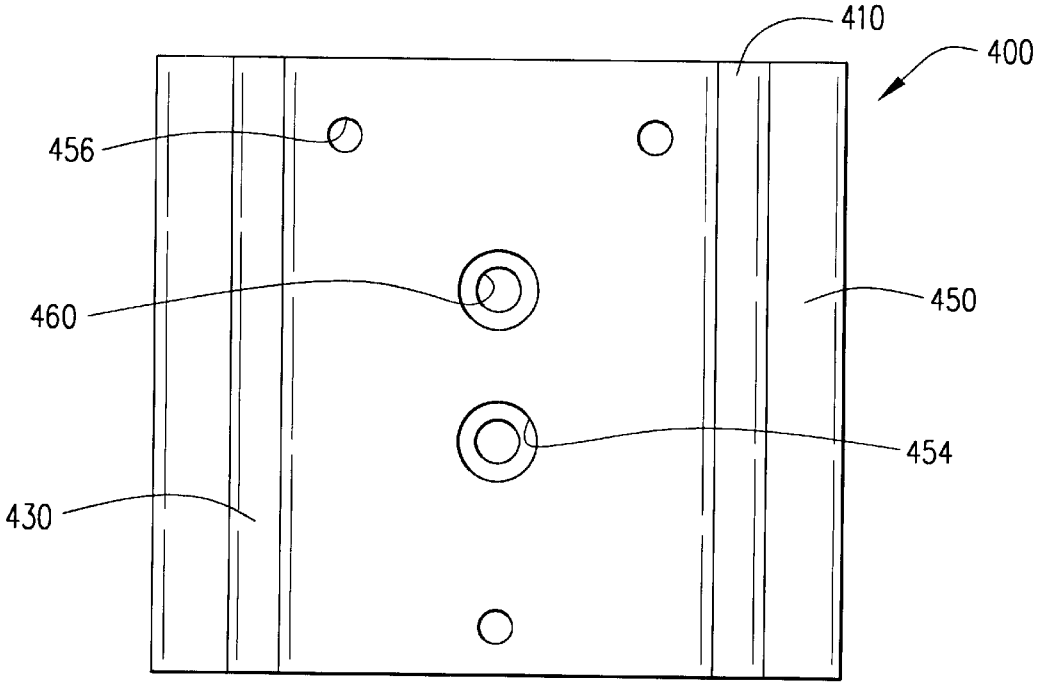
Figure 2C:
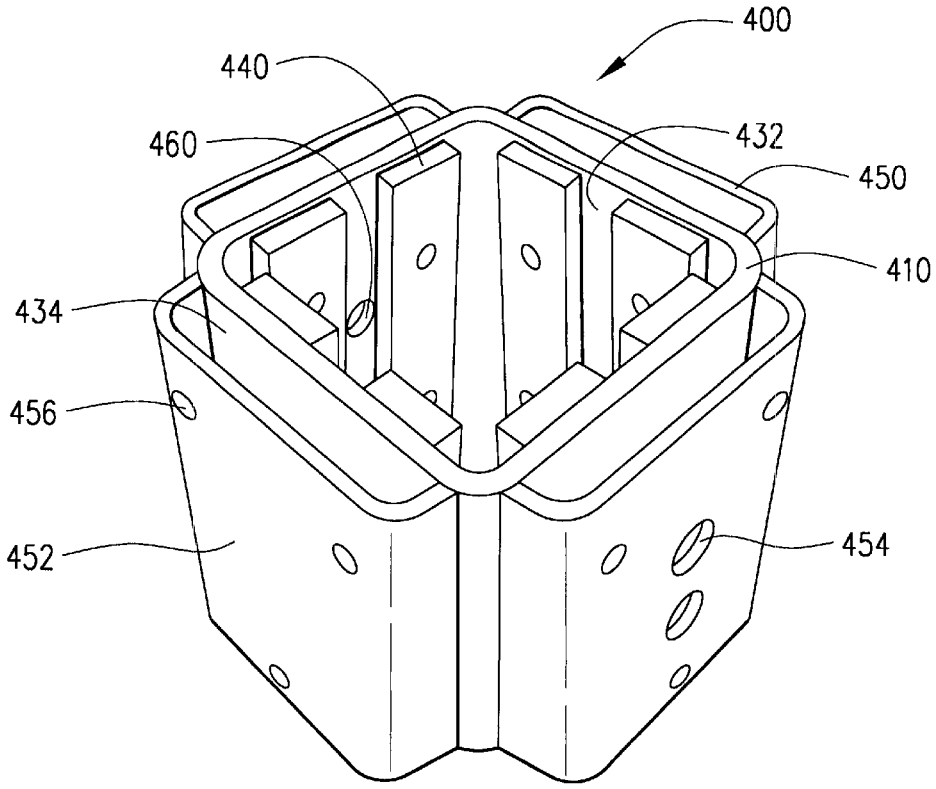

The slider assembly 400, as shown in FIGS. 2*a*–2*c*, more specifically comprises a frame member 410 having an internal diameter and a plurality of sides 430, each side 430 having an internal surface 432 lined with replaceable wear pads 440, the wear pads 440 present to reduce friction between the slider assembly 400 and the outer surface 160 of the main post 100. In a preferred embodiment, the frame member 410 of the slider assembly 400 is also square, fitting the main post 100, also preferably square. The internal diameter of the slider assembly 400, including the attached wear pads 440, is slightly greater than the outer diameter of the main post 100, with the ends 320 of the crossbar 300 extending through the longitudinal crossbar channel 170 in contact with the internal surface 432 of two opposing sides 430 of the frame member 410. Slider bolt holes 460 are located in the two opposing sides 430 of the frame member 410 in contact with the ends 320 of the crossbar 300, through which crossbar machine bolts 470 are inserted and tightened within the internally threaded slider bolt holes 325, firmly attaching the frame member 410 to the crossbar 300.

Figure 9:
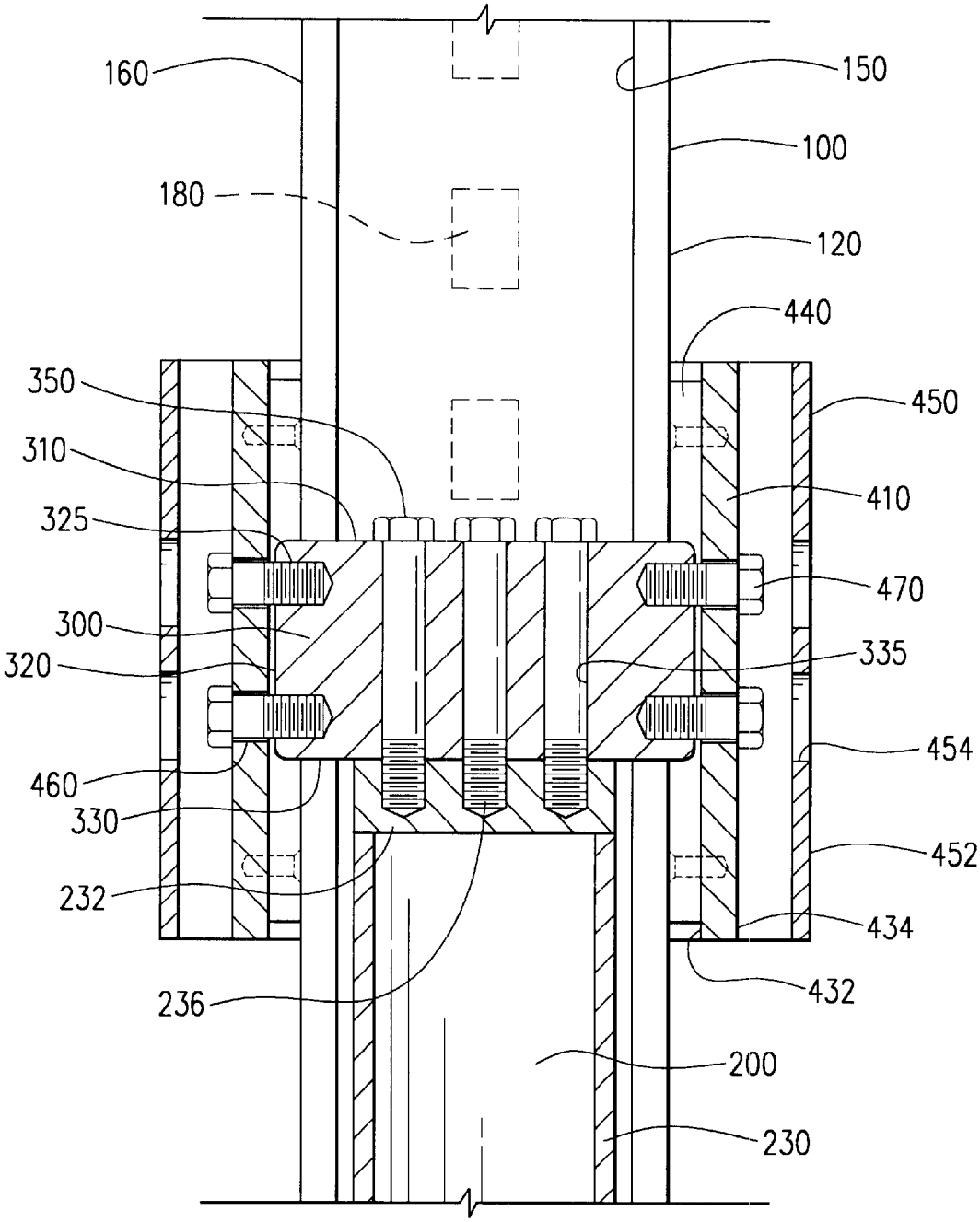
FIG. 9 is a side cross section view of the main post and slider assembly.

At least one side 430 of the frame member 410 also includes an external surface 434, additionally shown in FIG. 9 of the drawings, to which is attached an outer channel 450, the outer channel 450 having the flat outer surface 452 with multiple clamp adapter mounting holes 456 for mounting the adapter clamps 700. In a four sided embodiment, at least two of the opposing outer channels 450 are provided with crossbar machine bolt access holes 454 to allow access to attach and remove the crossbar machine bolts 470 from the crossbar 300 to remove the slider assembly 400 from the main post 100 for repair or periodical replacement of the wear pads 440. Most preferably, the wear pads 440 are made of a UHMW plastic, or another suitable material which has the capacity to eliminate metal to metal friction. In the square embodiment, as indicated previously, wherein the main post 100 is square and the slider assembly 400 is square, four flat outer surfaces 452 are provided to which may be simultaneously attached four clamp adapters 700 attaching to four transmission clamps fastened to four transmissions.

Figure 1:
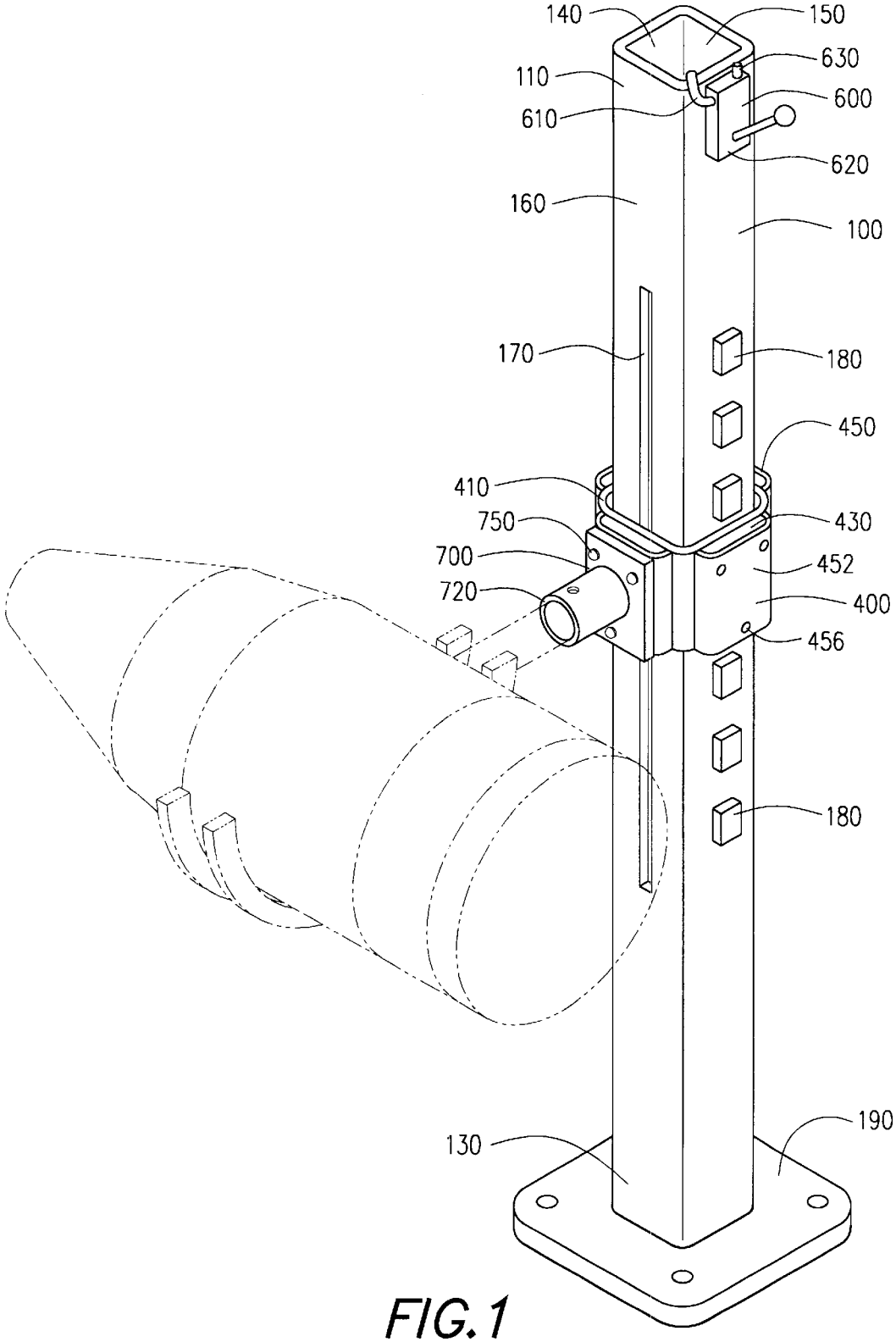

The clamp adapter 700, as shown in FIGS. 1, 12*a* and 12*b* of the drawings, comprises a flat adapter plate 710 having a plurality of slotted adapter plate attaching holes 715 in the same pattern, number and alignment as the multiple clamp adapter mounting holes 456, a primary adapter cylinder 720, projecting perpendicular from the adapter plate 710, and perhaps a secondary adapter cylinder 730 differing in size from the primary adapter 720, also projecting perpendicular from the adapter plate 710, adjacent to the primary adapter cylinder 720. Both the primary adapter cylinder 720 and the secondary adapter cylinders 730 include threaded engagement sockets 740 into which socket bolts 745 are inserted, as shown in FIG. 12*b*, to firmly engage transmission clamps that are inserted within the primary adapter cylinder 720 or the secondary adapter cylinder 730. Alternatively, socket pins 745*a* may be inserted through non-threaded engagement sockets 740*a*, as shown in FIGS. 12*a* and 12*b* of the drawings. The adapter plate 710 is attached upon the flat outer surface 452 of the outer channel 450 by the insertion of adapter plate attachment bolts 750 through each of the adapter plate attaching holes 715 bolted or welded within the clamp adapter mounting holes 456. The primary adapter cylinder 720 and the secondary adapter cylinder 730 are suited to accept the attachment to the multiplicity of transmission clamps accepting the plurality of automobile transmissions, not part of the subject transmission lift.

Also attached to the frame member 410 of the slider assembly 400 is the slider locking mechanism 500, which includes a means 510 of locking the slider assembly 400 to the main post 100 for maintaining an elevation of the slider assembly 400 along the length of the main post 100, preventing an unintentional lowering or drop of the slider assembly 400 on the main post 100.

Figure 11:
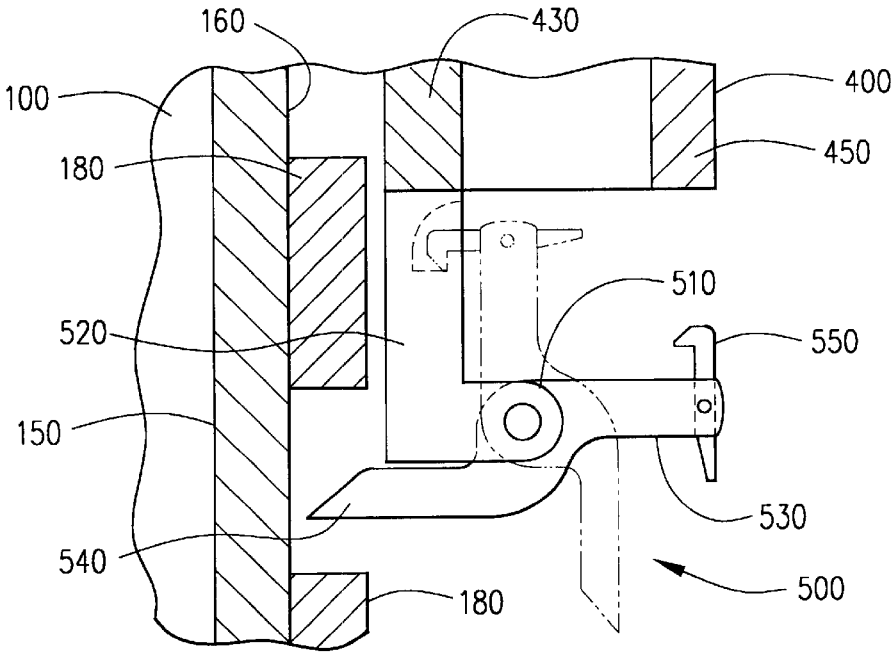
FIG. 11 is a view of an embodiment of the mechanical locking means.

This means 510 may include a lock plate 520 attached to the side 430 of the frame member 410 corresponding to the side 120 of the main post 100 having the longitudinally spaced locking lugs 180, the lock plate 520 having a pivotally mounted curved locking arm 530 having an engagement tooth 540 which, during the upward movement of the slider assembly 400 along the length of the main post 100, pivots the curved locking arm 530, disengaging and re-engaging the engagement tooth 540 from the longitudinally spaced locking lugs 180, preventing the lowering of the slider assembly 400 along the main post 100, yet without effect to the raising of the slider assembly 400 along the main post 100, as shown in FIG. 11 of the drawings. A locking arm catch 550, pivoting and holding the curved lock arm 530 and the engagement tooth 520 up and away from the longitudinally spaced locking lugs 180 during movement of the slider assembly 400 along the length of the main post 100 is presented, requiring the slider assembly 400 to be raised to some degree prior to the engagement of the locking arm catch 550. This locking arm catch 550 must be manually engaged with the curved lock arm 530 to lower the slider assembly 400 along the length of the main post 100.

Figure 10:
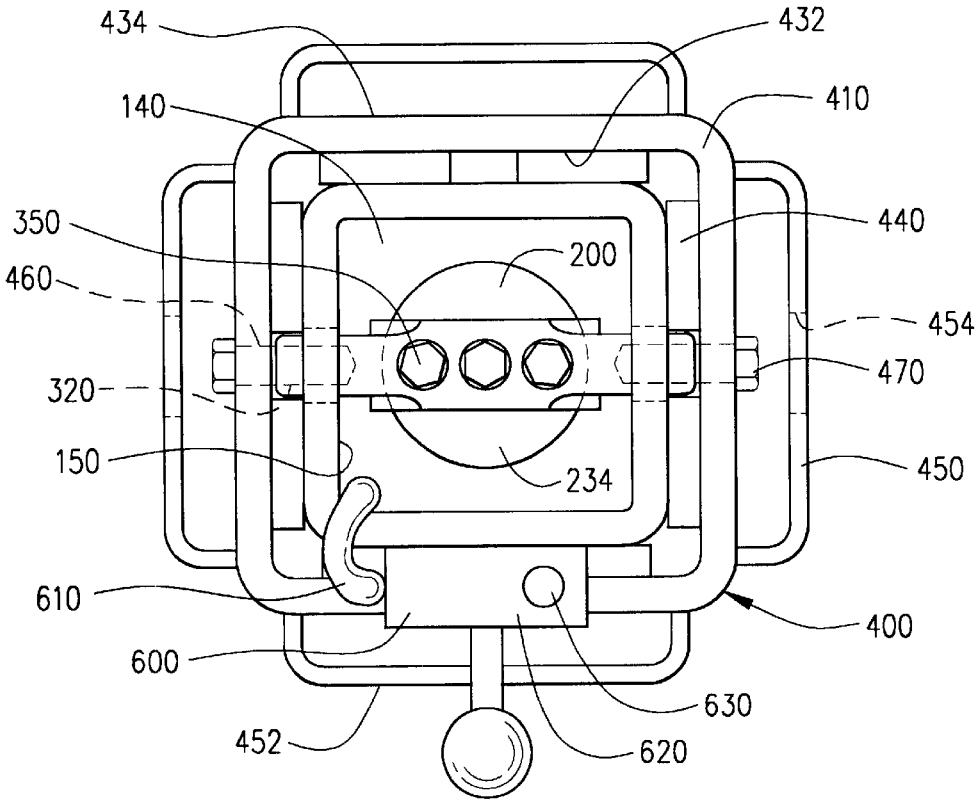
FIG. 10 is an inside top view of the transmission lift device looking down from the top of the main post.

The air supply assembly 600 includes an air supply line 610, attached to the air input receiver 222 of the air cylinder base 224, the air supply line 610 further attached to an air controller 620 having an air chuck attachment 630 for the compressed air line, the air controller 620 regulating the air supply to and from the piston air ram 200. In order to prevent any accidental damage to the air supply assembly 600 during operation of the transmission lift 10, it is preferred that the air supply line 610 be run from the upper end 110 of the main post 100, along the interior surface 150 of the interior longitudinal cavity 140, to the air input receiver 222 at the lower end 130 of the main post 100 mounted upon the base plate 190, with the air controller 620 at or near the upper end 110 of the main post 100, above the longitudinal crossbar channels 170, with the air chuck attachment 630 positioned at the upper end 110 of the main post 100 for connection to the compressed air line from overhead, as indicated in FIG. 10 of the drawings.

Figure 3A:
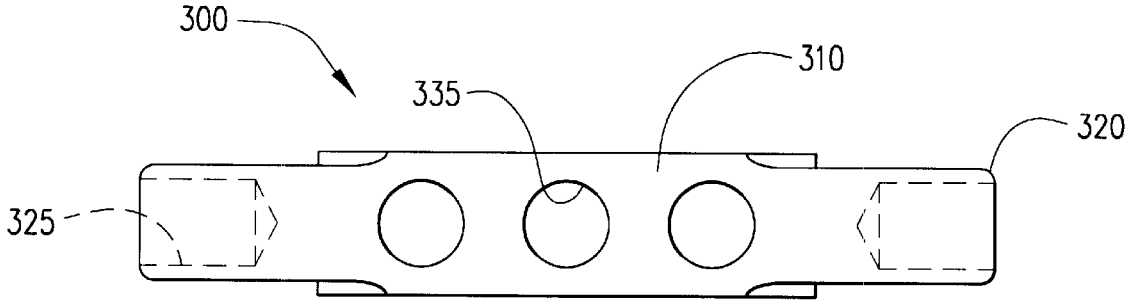
Figure 3B:
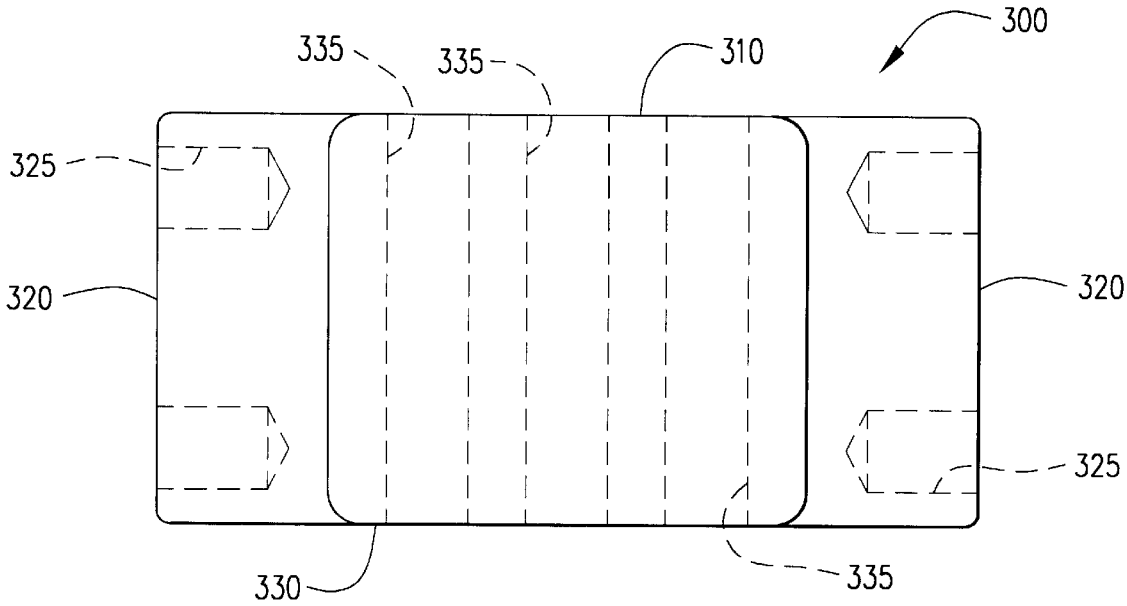
Figure 3C:
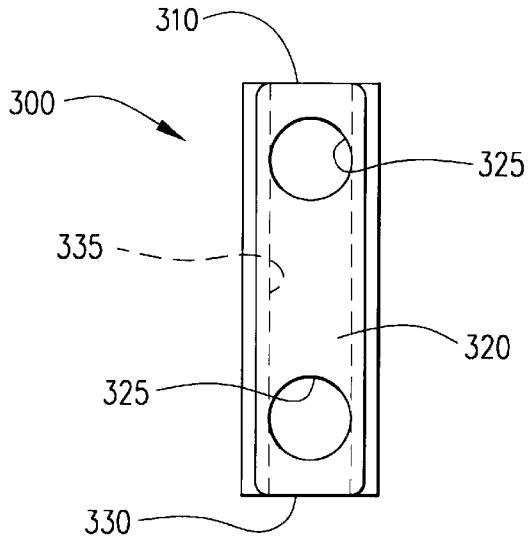
Figure 3D:
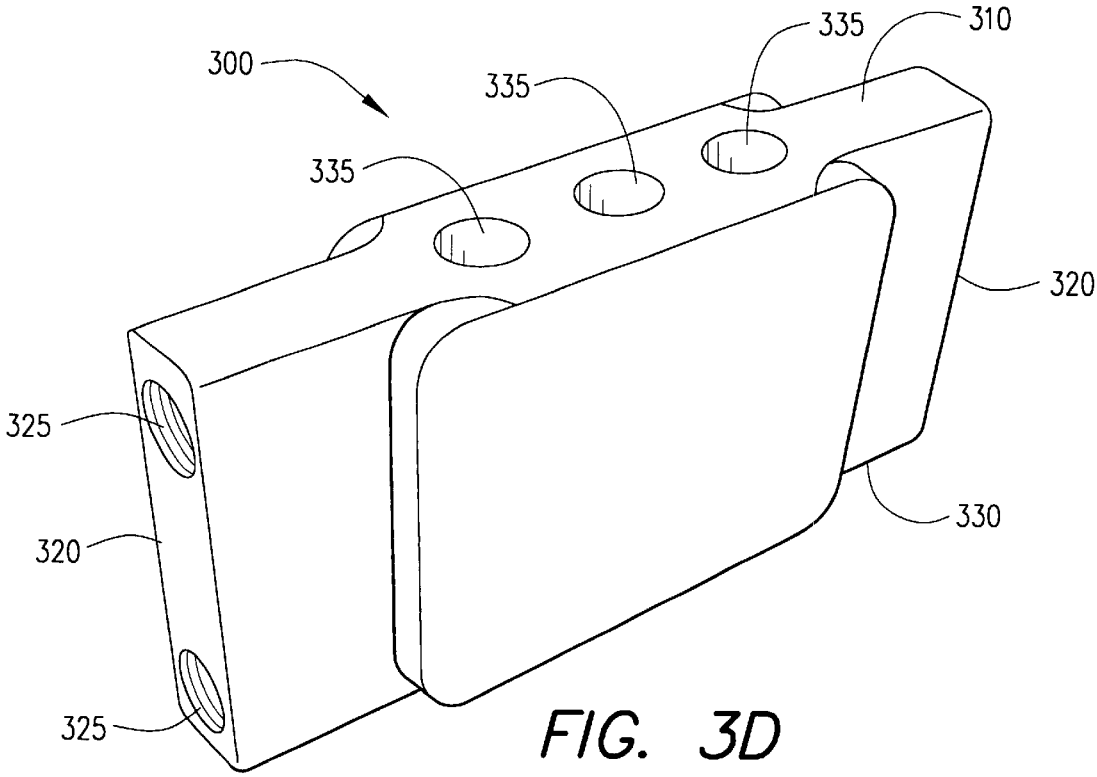
Figure 3E:
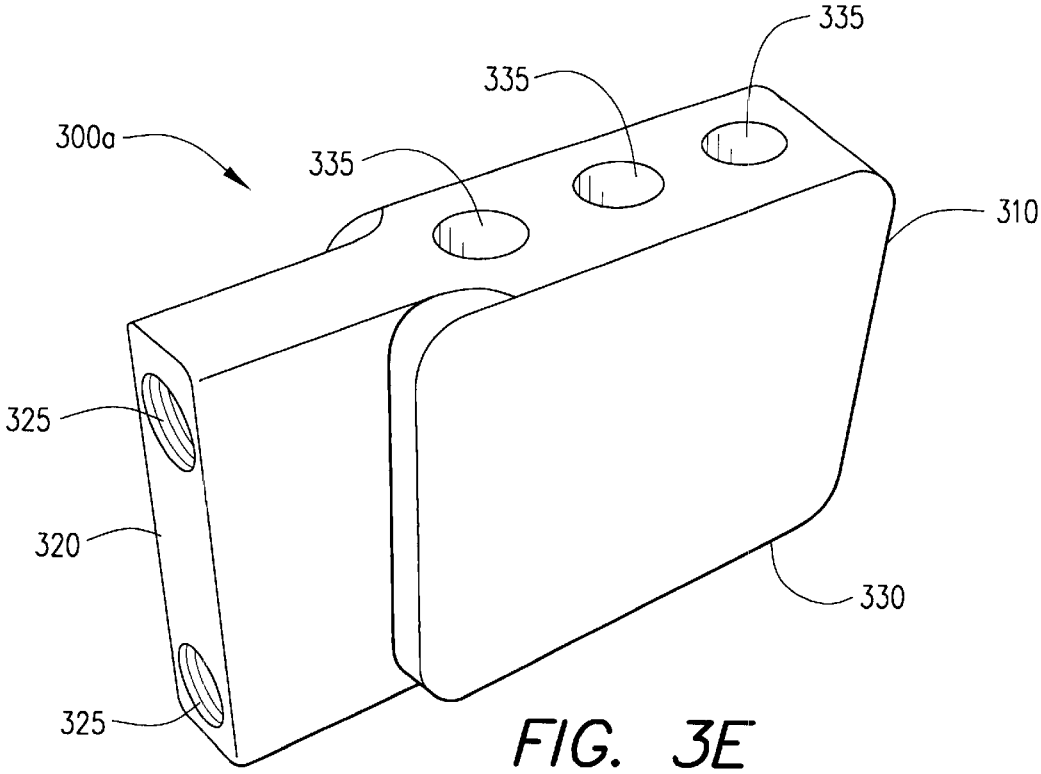
Figure 4A:
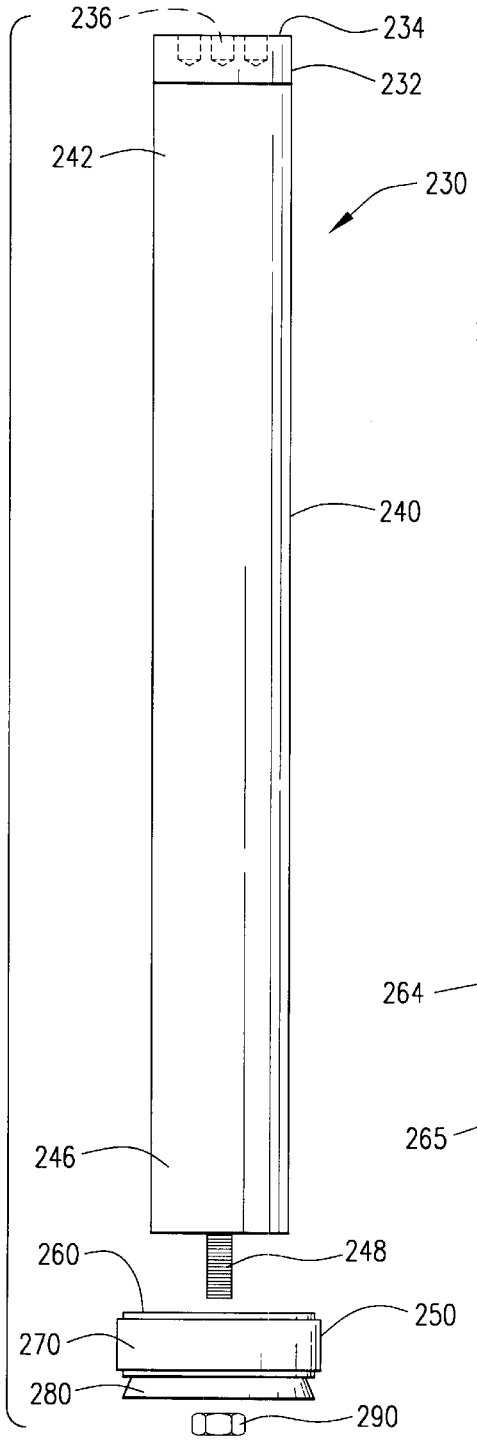
Figure 4B:
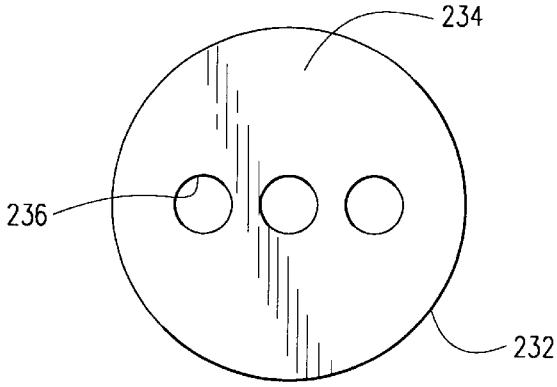
Figure 5A:
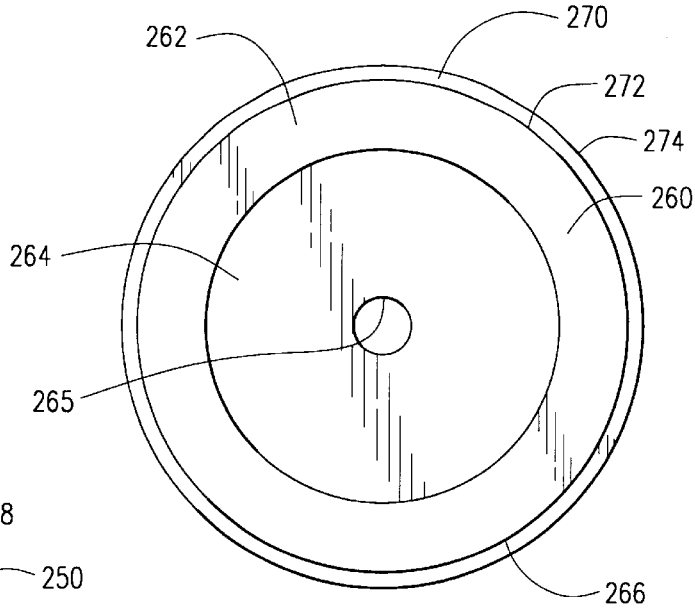
Figure 5B:
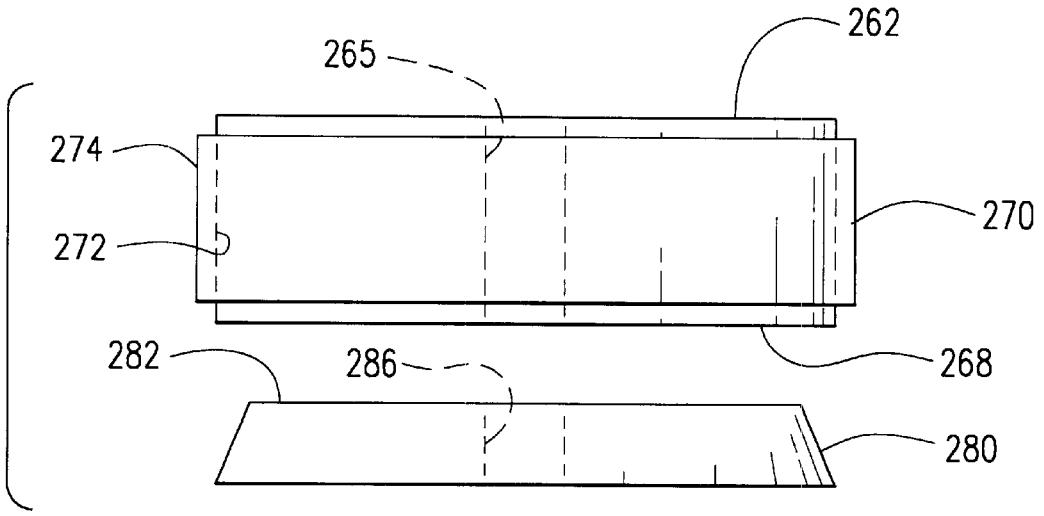
Figure 6:
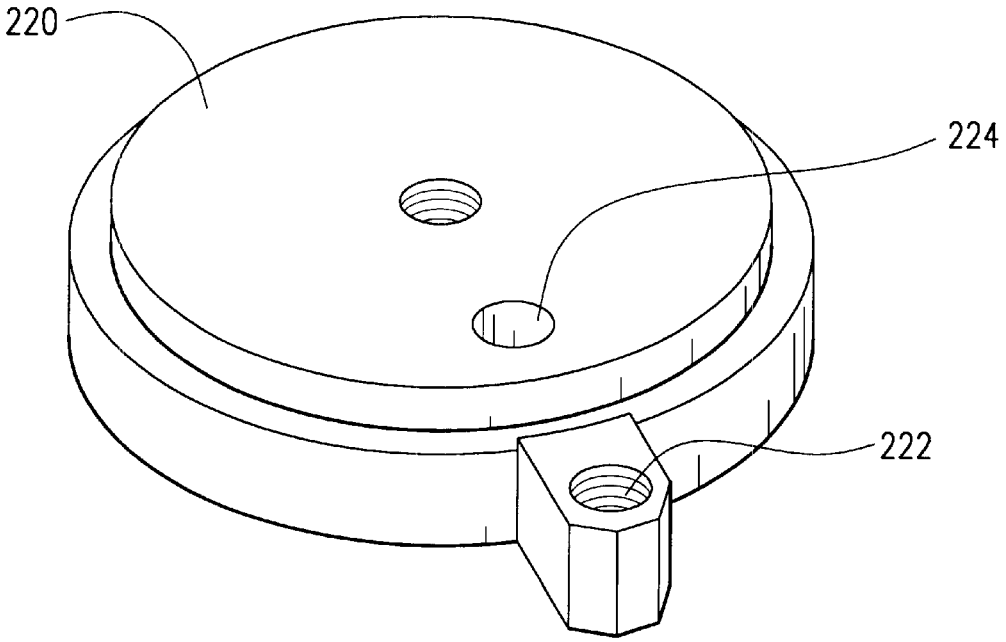
FIG. 6 is a side view of the air cylinder base.
Figure 7:
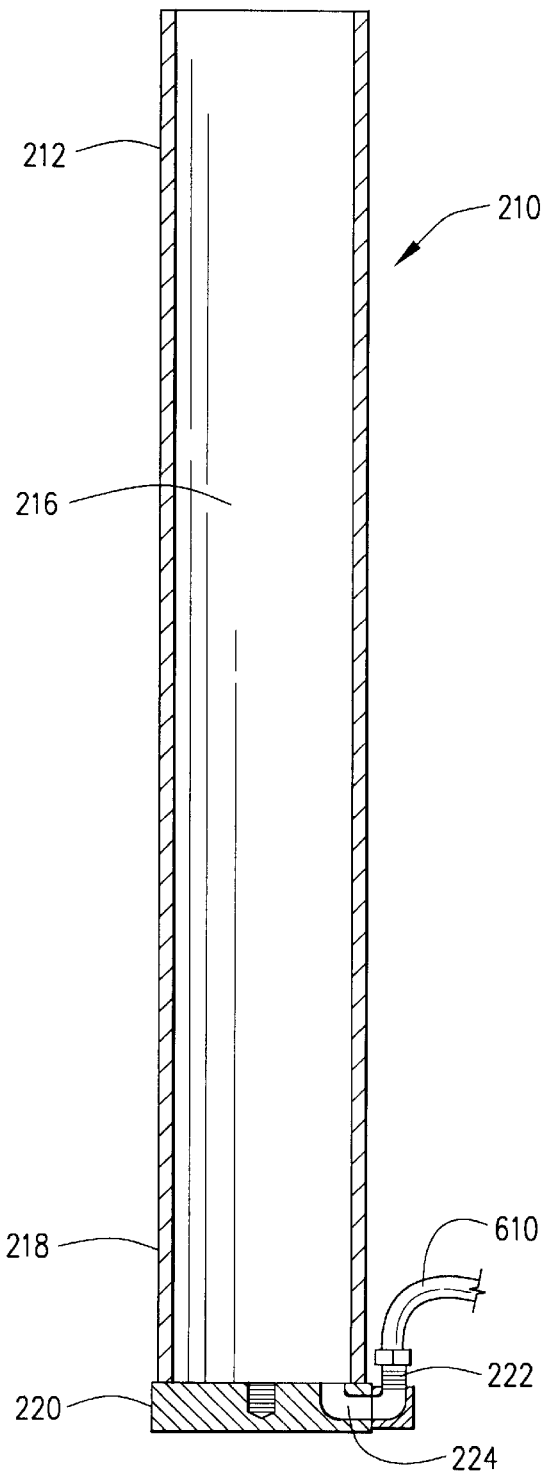
FIG. 7 is a cross-sectional side view of the air cylinder assembly.
Figure 8:
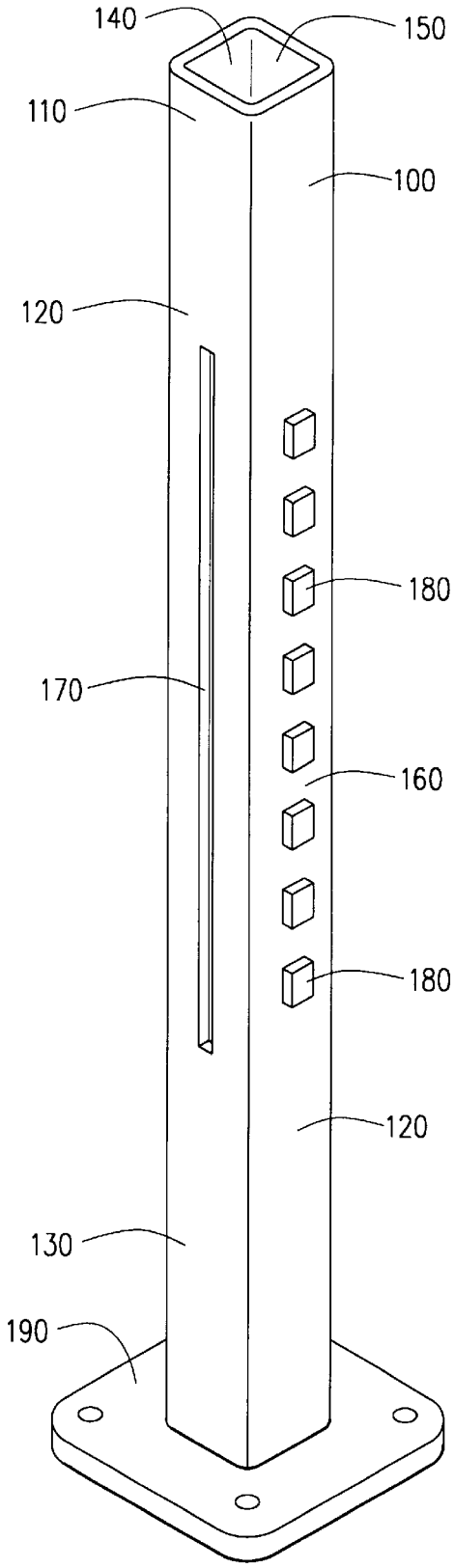
FIG. 8 is a perspective view of the main post.

In addition to the above disclosed and shown transmission lift 10, it is contemplated that the transmission lift 10 could also incorporate a hydraulic lift ram [not shown] instead of a pneumatic piston air ram 200. Additionally, it is contemplated that the base plate 190 could be mounted to a wheeled structure for portability, although this embodiment is also not shown in the drawings. In such portable embodiment or in an alternate embodiment to the previously disclosed transmission lift, a second embodiment of the crossbar 300*a* may be utilized, as shown in FIG. 3*e* of the drawings. This second embodiment of the crossbar 300*a* is also preferably a singular solid metal bar, having an upper surface 310, but only a single end 320 having at least two internally threaded slider bolt holes 325, a lower surface 330, a plurality of smooth bore machine bolt holes 335 through the second embodiment of the crossbar 300*a* from the upper surface 310 to the lower surface 330. This second embodiment of the crossbar 300*a* is also attached to the end cap 232 of the ram assembly 230 already within the interior longitudinal cavity 140 of the main post 100 by the insertion of at least two machine bolts 350 through the smooth bore machine bolt holes 335 of the crossbar 300*a* into the threaded crossbar anchor holes 236 of the end cap 232, tightening the crossbar 300*a* onto the end cap 232. The single end 320 of the second embodiment of the crossbar 300*a* extends through one longitudinal crossbar channel 170, slightly beyond the outer surface 160 of the main post 100. The frame member 410 is placed in contact with the end 320 of the second embodiment of the crossbar 300*a*, and the crossbar machine bolts 470 are inserted and tightened within the internally threaded slider bolt holes 325, firmly attaching the frame member 410 to the second embodiment of the crossbar 300*a*.

While the device has been particularly shown and described with reference to a preferred embodiment thereof, it will be understood by those skilled in the art that changes in form and detail may be made therein without departing from the spirit and scope of the invention, the invention contemplating the incorporation of a variety of shapes and sizes, as well as configuration and orientation of the various components not materially altering the nature and use of the device.

What is claimed is:

1. A pneumatic transmission lift upon which a plurality of automobile transmissions of various size, make and model may be attached and raised to a level to accommodate the repair, maintenance and rebuilding of the automobile transmissions, the transmission lift comprising essentially:

a. a vertical hollow main post having a plurality of sides, within which is attached;

b. a piston air ram, having
   i. an air cylinder assembly,
   ii. a ram assembly, and
   iii. a piston assembly, the piston air ram attaching to;

c. a crossbar, further attached to;

d. a slider assembly having a plurality of sides having flat outer surfaces to which may be secured a clamp adapter accepting an attachment of at least one transmission clamp fastened to at least one of the plurality of automobile transmissions, the slider assembly vertically sliding upon an outer surface of the main post with wear pads between the slider assembly and the main post to reduce friction between the slider assembly and the main post, the slider assembly also having;

e. a slider locking mechanism including a means of locking the slider assembly to the main post, preventing the slider assembly from being lowered without intent; and f. an air supply assembly, wherein the piston air ram receives compressed air through the air supply assembly placed upon and within the main post attaching to a compressed air line from a shop or garage where the pneumatic transmission lift is located.

2. The transmission lift, as disclosed in claim 1, wherein the main post is square and the slider assembly is square, providing up to four outer surfaces to which may be simultaneously attached up to four clamp adapters attaching to up to four transmission clamps fastened to four transmissions.

3. The transmission lift, as disclosed in claim 1, wherein the means of locking the slider assembly to the main post includes:

a. a lock plate attached to one of the sides of the frame member;

b. a pivotally mounted curved locking arm having an engagement tooth which, during the upward movement of the slider assembly along the main post, pivots the curved locking arm, disengaging and re-engaging the engagement tooth from longitudinally spaced locking lugs outwardly protruding from at least one side of the main post, such engagement tooth preventing the lowering of the slider assembly along the main post without effect to the raising of the slider assembly along the main post; and c. a locking arm catch, pivoting and holding the curved lock arm and the engagement tooth up and away from the longitudinally spaced locking lugs during movement of the slider assembly along the main post requiring the slider assembly to be raised prior to the engagement of the locking arm catch which must be engaged with the curved lock arm to lower the slider assembly along the main post.

4. The transmission lift, as disclosed in claim 1, wherein the wear pads are UHMW plastic.

5. A pneumatic transmission lift upon which a plurality of automobile transmissions of various size, make and model may be attached and raised to a level to accommodate the repair, maintenance and rebuilding of the automobile transmissions, the transmission lift comprising:

A. a main post having an upper end, a plurality of sides with at least two opposing sides, a lower end, an interior longitudinal cavity, an interior surface, an outer surface, two longitudinal crossbar channels in the two opposing sides, longitudinally spaced locking lugs in another side and a base plate attached to the lower end;

B. a piston air ram, further comprising
   1. an air cylinder assembly having an upper portion, an inner cavity, a lower portion,
      and an air cylinder base, having an air input receiver and an air access channel, the air cylinder base attaching to the lower portion of the air cylinder assembly with the air access channel enabling a flow of air through the air input receiver, through the air access channel into the inner cavity, 2. a ram assembly, having
   a. an end cap having an upper surface including a plurality of threaded crossbar anchor holes, connecting to
   b. an upper end of a ram arm, the ram arm further including a lower end from which extends a threaded piston mounting stud, and
3. a piston assembly, including
   a. a piston having an upper surface, a recess ram receiver area, a central mounting hole, an outer edge and a lower surface,
   b. a wear band having an inner surface and an outer surface,
   c. a rubber seal cup, having an upper surface, and a central mounting hole, wherein the piston assembly is assembled by forcing the wear band upon the piston, inserting the threaded piston mounting stud through the central mounting hole of the piston with the upper surface of the piston towards the ram arm with the lower end of the ram arm seated within the recessed ram receiver area, inserting the central mounting hole of the rubber seal cup onto the threaded piston mounting stud with the upper surface of the rubber seal cup in contact with the lower surface of the piston and tightening an internally threaded mounting nut on the threaded piston mounting stud, firmly attaching the piston assembly to the ram assembly, the assembled ram assembly and the piston assembly placed within the air cylinder assembly;

C. a crossbar including an upper surface, two ends having internally threaded slider bolt holes, a lower surface, a plurality of smooth bore machine bolt holes from the upper surface to the lower surface, through which at least two machine bolts are inserted, attaching the crossbar to the end cap, the machine bolts threaded and tightened into the plurality of threaded crossbar holes in the end cap;

D. a slider assembly including a frame member having an equal number of sides as the main post, conforming in shape to the main post, each side of the frame member having in internal surface lined with replaceable wear pads, the frame member further including slider bolt holes and an external surface to which is attached at least one outer channel, having a flat outer surface containing crossbar machine bolt access holes and a multiplicity of clamp adapter mounting holes to which the clamp adapter is attached, the slider assembly attaching to the two ends of the crossbar extending through the longitudinal crossbar channels of the main post, by the insertion and tightening of at least two crossbar machine bolts through the crossbar machine bolt access holes, through the slider bolt holes, into the internally threaded slider bolt holes;

E. a slider locking mechanism having a means of locking the slider assembly to the longitudinally spaced locking lugs along the main post; and F. air supply assembly, including an air supply line attached to the air input receiver of the air cylinder base, the air supply line further attached to an air controller having an air chuck attachment for a compressed air line, the air controller regulating the air supply to and from the piston air ram, thus controlling the amount of air to and from the piston air ram, raising and lowering the slider assembly along the main post.

6. The transmission lift, as disclosed in claim 5, wherein the main post is square and the slider assembly is square, providing four outer surfaces to which may be simultaneously attached four clamp adapters attaching to four transmission clamps fastened to four transmissions.

7. The transmission lift as disclosed in claim 5, alternatively comprising:

a. a crossbar including an upper surface, a single end having internally threaded slider bolt holes, a lower surface, a plurality of smooth bore machine bolt holes from the upper surface to the lower surface, through which at least two machine bolts are inserted, attaching the crossbar to the end cap, the machine bolts threaded and tightened into the plurality of threaded crossbar holes in the end cap, and;

b. the slider assembly attaching to the single end of the crossbar extending through the longitudinal crossbar channel of the main post, by the insertion and tightening of at least two crossbar machine bolts through the crossbar machine bolt access holes, through the slider bolt holes, into the internally threaded slider bolt holes.

8. The transmission lift, as disclosed in claim 5, wherein the means of locking the slider assembly to the main post includes:

a. a lock plate attached to one of the sides of the frame member;

b. a pivotally mounted curved locking arm having an engagement tooth which, during the upward movement of the slider assembly along the main post, pivots the curved locking arm, disengaging and re-engaging the engagement tooth from longitudinally spaced locking lugs outwardly protruding from at least one side of the main post, such engagement tooth preventing the lowering of the slider assembly along the main post without effect to the raising of the slider assembly along the main post; and c. a locking arm catch, pivoting and holding the curved lock arm and the engagement tooth up and away from the longitudinally spaced locking lugs during movement of the slider assembly along the main post requiring the slider assembly to be raised prior to the engagement of the locking arm catch which must be engaged with the curved lock arm to lower the slider assembly along the main post.

9. The transmission lift, as disclosed in claim 5, wherein the wear pads are UHMW plastic.

10. The transmission lift, as disclosed in claim 5, the clamp adapter further comprising:

a. a flat adapter plate having a plurality of slotted adapter plate attaching holes, configured and aligned with the multiple clamp adapter mounting holes of the flat outer surface of the outer channel;

b. a primary adapter cylinder projecting perpendicular from the adapter plate;

c. a secondary adapter cylinder differing in size from the primary adapter, also projecting perpendicular from the adapter plate and adjacent to the primary adapter cylinder, each primary adapter cylinder and secondary adapter cylinders including threaded engagement sockets and non-threaded engagement sockets into which engagement socket bolts and socket pins are respectively inserted, such engagement socket bolts tightened to firmly secure the multiplicity of transmission clamps within the primary adapter cylinder and the secondary adapter cylinder with the socket pins placed through aligned holes within the primary adapter cylinder, the secondary adapter cylinder and the transmission clamps; and d. adapter plate attachment bolts, placed through each of the adapter plate attaching holes securing the clamp adapter mounting holes of the flat outer surface of the outer channel.

* * * * *